US005943799A

United States Patent [19]

Xu et al.

[11] Patent Number: 5,943,799

[45] **Date of Patent: *Aug. 31, 1999**

[54] IRON HAVING AN ANTI-FRICTION LAYER

[75] Inventors: Yuan Xu; Peter R. Ten Brinke; Yong Ling Wu, all of Singapore, Singapore

[73] Assignee: U.S. Philips Corporation, New York, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 08/902,738

[22] Filed: Jul. 30, 1997

Related U.S. Application Data

[63] Continuation of application No. 08/557,221, Nov. 14, 1995, abandoned.

[30] Foreign Application Priority Data

Nov. 14, 1994 [BE] Belgium ..... 09401021

[51] Int. Cl.[6] ..... D06F 75/38

[52] U.S. Cl. ..... 38/93

[58] Field of Search ..... 38/93, 97; 219/245; 427/9, 453, 450, 458, 250, 328

[56] References Cited

U.S. PATENT DOCUMENTS

| | | | |
|---|---|---|---|
| 4,665,637 | 5/1987 | Kramer | 38/93 |
| 4,822,686 | 4/1989 | Louison et al. | 38/93 X |
| 4,862,609 | 9/1989 | Ullrich et al. | 38/93 |
| 5,025,578 | 6/1991 | Firatli et al. | 38/93 |

FOREIGN PATENT DOCUMENTS

| | | | |
|---|---|---|---|
| 0217014 | 4/1987 | European Pat. Off. . | |
| 0378479 | 7/1990 | European Pat. Off. . | |
| 640714 | 3/1995 | European Pat. Off. . | |
| 60-25999 | 5/1985 | Japan . | |
| 2129100 | 6/1987 | Japan | 38/93 |

*Primary Examiner*—Ismael Izaguirre
*Attorney, Agent, or Firm*—Ernestine C. Bartlett

[57] ABSTRACT

An iron and a soleplate having an improved anti-friction layer are provided. Said soleplate is characterized in that the anti-friction layer consists predominantly of aluminum oxide which is formed in an electrochemical manner. The anti-friction layer on the inventive soleplate and hence on the inventive iron can be provided in a simple and cheap manner. It has additionally been found that the layer thus provided meets a large number of requirements, such as a sufficient degree of hardness, good anti-friction properties, a low corrosion resistance a good scratch resistance, good gliding properties and that it is easy to clean such a layer. If desired, the anti-friction layer is applied to an intermediate layer which is situated between the anti-friction layer and the soleplate. By virtue thereof, use can be made of an injection-moldable aluminum soleplate on which an electrochemical anti-friction layer is more difficult to form. The intermediate layer consists of a sprayed aluminum layer or an anodizable aluminum layer. If desired, the color of the anti-friction layer can be varied by means of coloring techniques.

24 Claims, 1 Drawing Sheet

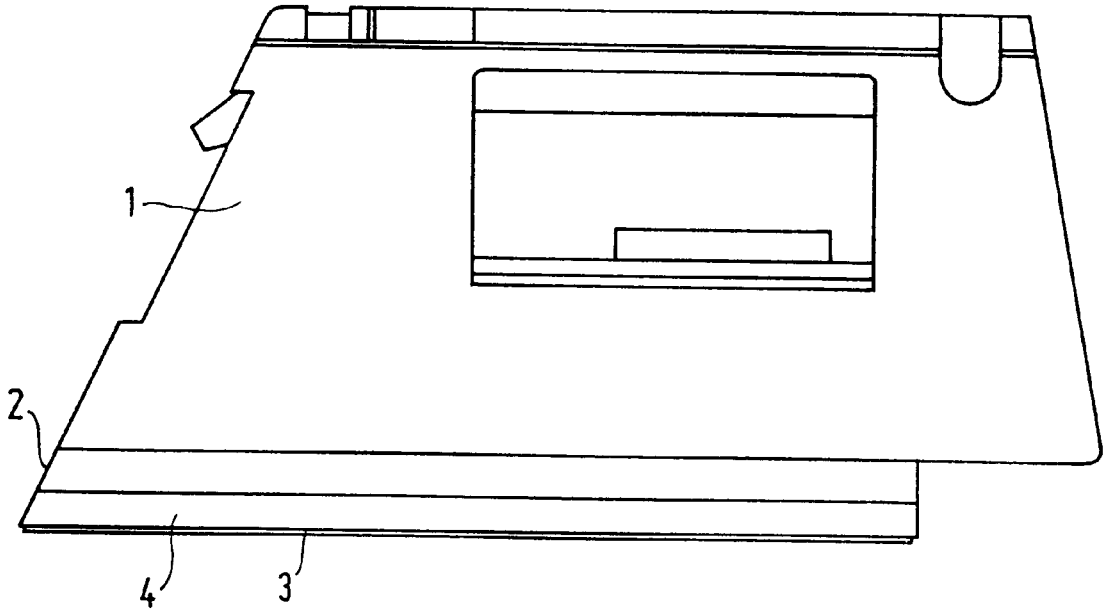
1
2
4
3

IRON HAVING AN ANTI-FRICTION LAYER

This is a continuation of application Ser. No. 08/557,221, filed Nov. 14, 1995 now abandoned.

FIELD OF THE INVENTION

The invention relates to an iron comprising a metal soleplate which is provided with an anti-friction layer. The invention also relates to a soleplate which is provided with a heating element and an anti-friction layer, said soleplate being suitable for use in an iron.

BACKGROUND OF THE INVENTION

Irons are generally composed of a housing, usually of a synthetic resin, to which a soleplate is connected. Said soleplate is customarily made of aluminum, but it can alternatively be made from zinc, nickel, copper or stainless steel. In general, a separate layer, which is commonly referred to as anti-friction layer, is applied to the surface of the soleplate facing away from the housing of the iron. During ironing, this anti-friction layer directly contacts the clothes to be ironed. A prerequisite for the proper functioning of the iron is that such an anti-friction layer meets a large number of requirements. For example, the anti-friction layer must, inter alia, exhibit satisfactory anti-friction properties on the clothes to be ironed, it must be corrosion-resistant, scratch-resistant, and durable and exhibit an optimum hardness and a high resistance to wear and to fracture. The material of the anti-friction layer must meet extra high requirements because the anti-friction layer is exposed to substantial variations in temperature ranging between 10° C. and 300° C. Some of said requirements are more or less contradictory from the viewpoint of materials science.

An iron of the type mentioned in the opening paragraph is known per se, for example, from European Patent Application EP-A 217.014. The iron described in said Application comprises a soleplate of aluminum, which is provided with an anti-friction layer of a ceramic material, preferably aluminum oxide. This anti-friction layer is provided by means of plasma spraying. In this process, spherical aluminum oxide particles having a diameter of, for example, 10 microns are heated by means of a plasma jet and sprayed onto the soleplate. In this process, a bonded ceramic layer of aluminum-oxide particles is formed. Subsequently, this anti-friction layer is polished to obtain the desired smoothness.

The known iron has disadvantages. It has been found that the ceramic anti-friction layer has a relatively high porosity and a relatively low corrosion resistance. In addition, the anti-friction properties, particularly the anti-stick properties, of the known layer are not optimal and keeping the layer clean as well as cleaning it has proved to be difficult. Finally, the processes of providing and polishing the anti-friction layer are expensive and cannot easily be carried out in mass-production.

SUMMARY OF THE INVENTION

It is an object of the invention to overcome the disadvantages of the known iron. The invention more particularly aims at providing an iron as well as a soleplate which can be mass-produced at low cost. The anti-friction layer of the soleplate must also have a satisfactory corrosion resistance as well as a low porosity.

These and other objects of the invention are achieved by an iron of the type mentioned in the opening paragraph, which is characterized in that the anti-friction layer consists of a layer of predominantly aluminum oxide which is formed in an electrochemical manner.

An electrochemically formed anti-friction layer has the important advantage that it can be rapidly and cheaply provided on a soleplate in mass-production. In spite of the fact that the electrochemically formed layer is not subsequently subjected to a polishing treatment, its coefficient of friction is optimal for ironing. In addition, the inventive iron has still other favorable properties, such as in particular a high scratch resistance and a high durability of such an electrochemically formed metal-oxide layer. In addition, the resistance to fracture of the anti-friction layer is at least equal to that of the known sprayed layer of ceramic aluminum oxide. The thickness of the metal-oxide layer of the inventive iron is preferably 10 to 50 micrometers, in particular 15 to 25 micrometers.

The expression "electrochemically formed layer" is to be understood to mean herein that the metal at the surface of the soleplate is electrochemically oxidized to form a thin layer of metal oxide. This layer is formed by immersing the surface of, preferably, a polished soleplate and an inert electrode, for example of aluminum, lead or graphite, into a suitable, preferably, acidified salt solution. For this purpose, an AC or DC voltage difference must be applied across the soleplate and the electrode, in which process the soleplate serves as the anode. Specific variants of this process are commonly referred to as (hard) anodizing, eloxing and opalizing.

A favorable embodiment of the iron in accordance with the invention is characterized in that the soleplate is made of aluminum which is processed by means of injection molding, and in that an intermediate layer is situated between the anti-friction layer and the soleplate.

The manufacture of soleplates from aluminum is preferably carried out by means of injection molding. Aluminum which can suitably be processed by means of injection molding comprises a considerable quantity of other elements, such as silicon and/or magnesium. These additions reduce the melting temperature of aluminum, so that it has the required degree of fluidity at the temperature at which injection molding is carried out. The quantities of said additions are customarily 5% by weight or more. It has however been found that the manufacture of a homogeneous, electrochemical layer on injection-moldable aluminum is generally not very well possible. This is caused by the presence of certain types of precipitates in the aluminum. This problem can be solved by an additional layer between the soleplate and the anti-friction layer.

In accordance with another preferred embodiment of the iron in accordance with the invention, said intermediate layer is provided by metal spraying of aluminum. Such a layer formed by metal spraying bonds well to the soleplate of injection-moldable aluminum. In addition, it has been found that an aluminum-oxide anti-friction layer which is electrochemically provided on said intermediate layer also bonds well and exhibits a satisfactory hardness and a uniform homogeneity.

In an especially preferred embodiment of the iron in accordance with the invention, the intermediate layer consists of a plate of anodizable aluminum which is secured to the soleplate. To secure the plate to the soleplate use can be made of a thermostable adhesive and/or a mechanical connection, for example screws. As can be inferred from the expression "anodizable aluminum", the types of aluminum in question can be effectively treated in an electrochemical manner.

If desired, the anti-friction properties of the soleplate can be further improved by providing the surface of the anti-friction layer with predominantly parallel, linear structures, as described, inter alia, in European Patent Application EP-A 378.479. Said structures must be present on the surface of the soleplate before the soleplate is electrochemically treated.

The invention also relates to a soleplate which is provided with a heating element as well as an anti-friction layer. In accordance with the invention, this soleplate comprises a layer which consists predominantly of aluminum oxide and which is formed electrochemically. Such a soleplate can very suitably be used in an iron of the type described hereinabove.

BRIEF DESCRIPTION OF THE DRAWINGS

The invention will be explained in greater detail by means of exemplary embodiments and a drawing, in which the sole FIGURE shows an iron in accordance with the invention.

It is noted that for the sake of clarity, the components are not drawn to scale.

DETAILED DESCRIPTION OF THE PREFERRED EMBODIMENTS

The FIGURE shows a steam iron. Said iron comprises a synthetic resin housing (1) whose bottom side is provided with a metal soleplate (2). In this case, the soleplate is made of aluminum which has been shaped by injection molding. The soleplate (2) is provided with an anti-friction layer (3) on the side facing away from the housing. Said anti-friction layer consists of a layer of aluminum oxide which has been formed electrochemically. In this case, the thickness of the anti-friction layer is approximately 20 micrometers. An intermediate layer (4) is situated between the anti-friction layer (3) and the soleplate (2). As will be described in greater detail hereinbelow, this intermediate layer may be provided by metal spraying of aluminum. However, the intermediate layer (4) preferably consists of a plate of anodizable aluminum which is secured to the soleplate (2) by means of a thermostable adhesive and/or screws. It is noted that the intermediate layer (4) may be omitted if the soleplate is made of anodizable aluminum. Further, it is noted that the invention is not limited to steam irons, but can also be applied to conventional irons without steam-generating means.

The soleplate (2) comprises a heating element (not shown) on the side facing away from the anti-friction layer. As is known per se, this heating element may consist of a metal pipe in which a heating wire is provided which is embedded in an electrically insulating material of metal oxides. Preferably, however, use is made of a heating element which consists of a resistive layer of thick-film material which is provided in accordance with a pattern and which is situated between two electrically insulating layers which consist preferably of enamel.

The manufacture and the ironing properties of the iron in accordance with the invention will be explained by means of the following exemplary embodiments.

EXEMPLARY EMBODIMENT 1.

In this exemplary embodiment use was made of a soleplate of anodizable aluminum, namely AlMgSi0.5, which was shaped in a metal-removing process (milling). The ironing surface of this sole was degreased by treating this surface with an aqueous solution of sodium phosphate (5–10 wt. %) for 5 minutes at a temperature of 50° C. After an electro-chemical polishing treatment, the surface roughness ($R_a$) of the ironing surface was 0.5 micrometer.

The ironing surface was subsequently provided with an electrochemically formed anti-friction layer. To this end, said surface was anodized in an aqueous solution of 15–18% sulphuric acid for 30–45 min at a temperature of approximately 5° C. The current density was 10–30 mA/cm$^2$. Under these conditions, a layer of aluminum oxide having a thickness of approximately 25 micrometers was formed on the soleplate.

The anodized layer was subsequently "sealed" in deionized water at a temperature of 98° C. The anti-friction layer thus obtained had a uniform texture and a silver/grey appearance. The soleplate with the anti-friction layer was then secured to a housing and subjected to a number of tests. Measurements showed that the anti-friction layer had an optimum roughness ($R_a$=0.5 micrometer) and an optimum hardness (HV>450). Drop tests showed that the resistance to fracture was very satisfactory.

EXEMPLARY EMBODIMENT 2.

In this case, a soleplate of injection-moldable aluminum was used. In addition to aluminum, being the main constituent, it also contained 12 wt. % Si. The surface of the soleplate was scoured and ground and subsequently degreased, and wet-chemically etched.

Next, an anodized layer of aluminum oxide was provided on the soleplate in the manner essentially described in exemplary embodiment 1. In this case, a layer thickness of 35 micrometers was provided. It was found that the hardness of the anti-friction layer formed was much lower than that of exemplary embodiment 1. Further visual inspection showed that the texture of the anti-friction layer was irregular and that there were cavities in the layer. In addition, the color of the layer was irregular. It was found that the scratch resistance of the anti-friction layer was not optimal.

EXEMPLARY EMBODIMENT 3.

The ironing surface of an injection-molded soleplate whose composition corresponds to that of exemplary embodiment 2 was pre-treated by means of sand blasting. A thin layer of pure aluminum was subsequently sprayed on said pre-treated surface. The metal-spraying process took place in an oxygen-containing atmosphere. The layer can be provided by means of flame spraying as well as plasma spraying. The layer formed (thickness 0.1–2.0 mm) bonded well to the injection-moldable aluminum. The layer predominantly consists of a mixture of aluminum and alumina. The sprayed layer was subsequently ground and polished. Next, an anti-friction layer was electrochemically formed on the sprayed intermediate layer. The thickness of the layer ranges between 15 and 50 micrometers. An aqueous solution of oxalic acid (7%) was used as the anodizing bath. The bath temperature was 20 degrees Celsius, the current density was 2.5 A/dm$^2$ and the anodizing time 50–60 minutes.

After "sealing" of the anti-friction layer at 98° C. in demineralized water, the soleplate was secured to a housing. The iron thus manufactured was subjected to a number of measurements. It was found that the anti-friction layer formed had a uniform 'granite' texture and was of a beige-grey color.

EXEMPLARY EMBODIMENT 4.

A thin plate (thickness 2 mm) of anodizable aluminum (type AA 5052 (AlMg 2.5) or type AA 6061 (AlMg1SiCu))

was secured to the ironing surface of an injection-molded soleplate (see exemplary embodiment 2) by means of a thermostable adhesive (Shin Etsu KE 1830) and screws. Instead of screws, rivet studs can also be used. In this embodiment, the surface of the soleplate did not have to be pre-treated. Both surfaces of said plate had previously been provided with a 40 microns thick aluminum-oxide anti-friction layer in an electrochemical manner. This anti-friction layer was provided on the plate in the manner essentially described in exemplary embodiment 1.

The properties and texture of the anti-friction layer were found to be substantially identical to those of the anti-friction layer of exemplary embodiment 1. Measurements showed that the layer had a suitable coefficient of friction in the case of cotton (static value 0.13 and dynamic value 0.17) and polyester (static value 0.20 and dynamic value 0.21). The scratch resistance was about 5 on Mohs' scale of hardness. The layer further demonstrated a good resistance to wear as well as reasonably good anti-stick properties.

EXEMPLARY EMBODIMENT 5.

A thin plate of anodizable aluminum was secured to an injection-molded soleplate by means of screws and a thermostable adhesive (Toshiba XE-13-A8341). Before the plate was secured to the soleplate, it had been electrochemically provided with an aluminum-oxide layer having a thickness in the range of 15–30 microns. In this case, optimal gliding properties were achieved by a pre-treatment of 9 minutes etching and 1 minute polishing. After anodizing (aqueous solution comprising 7% oxalic acid) and sealing in a customary manner, this anti-friction layer was of a yellowish green color and had a uniform texture. The properties and the texture (layer roughness and asperity radius) of the anti-friction layer were found to be better than those of the anti-friction layer of exemplary embodiment 4: The friction coefficient on cotton are 0.11 (static) and 0.15 (dynamic) and on polyester 0.14 (static) and 0.18 (dynamic). The scratch resistance on Mohs' scale of hardness was 6.

EXEMPLARY EMBODIMENT 6.

Also in this exemplary embodiment, an iron was manufactured comprising an intermediate layer consisting of a plate of anodizable aluminum provided with a thin anti-friction layer of electrochemically formed aluminum oxide. This iron was manufactured in the manner essentially described in exemplary embodiment 4. In the present exemplary embodiment, the anti-friction layer was subjected to a coloring treatment after anodizing and before "sealing" of the intermediate layer. To this end, the anti-friction layer was introduced into a bath to which a dye was added. To obtain a green color, first copper sulphate (25 g/l, for 3 minutes at room temperature) was added as a dye, whereafter ammonium sulphate (5 wt. % for 3 minutes at room temperature) was added. To obtain a blue color, first ammonium oxalate (for 2 minutes at room temperature) was added as a dye and subsequently potassium ferrocyanide (for 2–3 minutes at room temperature) was added. The desired color was preserved during "sealing" of the anti-friction layer. The other properties of the layer were identical to those of exemplary embodiment 4.

It is noted that the metal-oxide layer can also be colored by means of other methods which are customarily used in the anodizing process. Examples thereof are, in particular, electrolytic coloring, integral coloring or interference coloring of the layer. It is alternatively possible to use organic dyes instead of inorganic dye salts. The anti-friction (gliding) property of the coated sole plates is determined by the topography of the surface. The surface topography is characterized by two main parameters:

Arithmetic mean roughness value ($R_a$)

Average asperity radius.

These two parameters (in popular terms: height and sharpness of the peaks) are controllable by the chemical etching and polishing processes of the sole plates prior to anodizing. By varying the chemical etching duration, different $R_a$ values are achieved. The optimum range of $R_a$ value is 0,4–0,9 $\mu$m. Similarly, by varying the chemical polishing duration, a wide range of asperity radius can be achieved. The optimum range of asperity radius is 100–250 $\mu$m. With these optimized $R_a$ value and asperity radius, anodized sole plates according to the present invention possesses very low and balanced friction coefficients on many types of fabrics:

| FABRIC TYPE and SOLEPLATE TEMPERATURE [° C.] | | FRICTION COEFFICIENT STATIC | FRICTION COEFFICIENT DYNAMIC (at 0.3 m/s) |
|---|---|---|---|
| cotton | (200° C.) | 0.10–0.13 | 0.14–0.16 |
| polyester | (150° C.) | 0.13–0.16 | 0.17–0.20 |
| silk | (150° C.) | 0.09–0.13 | 0.17–0.19 |
| wool | (175° C.) | 0.10–0.12 | 0.16–0.18 |
| viscose | (200° C.) | 0.08–0.11 | 0.13–0.14 |
| acetate | (150° C.) | 0.10–0.12 | 0.15–0.16 |

It has been found that a soleplate of an iron having an anti-friction layer which is formed by electrochemically oxidizing an aluminum layer has excellent anti-friction properties. In particular the embodiment in which an intermediate layer in the form of an anodizable aluminum plate is provided between the anti-friction layer and the soleplate is considered to be very favorable as it can be manufactured in a simple manner.

We claim:

1. An iron comprising an injection molded sole plate of a metal comprising aluminum provided with an anti-friction layer of predominantly aluminum oxide, which layer of predominantly aluminum oxide is electrochemically formed on said sole plate of aluminum, and wherein an intermediate layer is situated between the anti-friction layer and the soleplate.

2. An iron as claimed in claim 1, wherein the thickness of the anti-friction layer ranges between 10 and 50 micrometers.

3. An iron as claimed in claim 1, wherein the arithmetic mean roughness value ($R_a$) is in the range of 0.4–0.9 micrometer, and the average asperity radius is in the range of 100–250 micrometer.

4. An iron as claimed in claim 1, wherein the soleplate is provided with predominantly parallel, linear structures.

5. An iron comprising an injection molded sole plate of metal comprising aluminum provided with an anti-friction layer of predominantly aluminum oxide, said layer being electrochemically formed on said sole plate of aluminum by applying a voltage difference across the soleplate and an electrode in the presence of an electrically conductive material, and wherein an intermediate layer is situated between the anti-friction layer and the soleplate.

6. An iron as claimed in claim 5, wherein the thickness of the anti-friction layer ranges between 10 and 50 micrometers.

7. An iron as claimed in claim 5, wherein the arithmetic mean roughness value ($R_a$) is in the range of 0.4–0.9 micrometer, and the average asperity radius is in the range of 100–250 micrometer.

8. An iron as claimed in claim 5, wherein the soleplate is provided with predominantly parallel, linear structures.

9. A soleplate which comprises an injection molded metal surface comprising aluminum provided with an anti-friction layer of predominantly aluminum oxide, which layer of predominantly aluminum oxide is electrochemically formed on said metal surface, and wherein an intermediate layer is situated between the anti-friction layer and the substrate.

10. A soleplate as claimed in claim 9, wherein the thickness of the anti-friction layer ranges between 10 and 50 micrometers.

11. A soleplate as claimed in claim 9, having an arithmetic mean roughness value ($R_a$) in the range of 0.4–0.9 micrometer, and an average asperity radius in the range of 100–250 micrometer.

12. A soleplate as claimed in claim 9, wherein the injection molded metal surface is provided with predominantly parallel, linear structures.

13. A soleplate as claimed in claim 9, which is provided with a heating element.

14. A method of manufacturing an iron which comprises a soleplate of a metal comprising aluminum, an anti-friction layer consisting of a layer of predominantly aluminum oxide, and an intermediate layer situated between the anti-friction layer and the soleplate, which method comprises the steps of injection molding said soleplate of a metal comprising aluminum, providing said intermediate layer by metal spraying of aluminum on a surface of said injection molded soleplate, and electrochemically forming said anti-friction layer on a surface of said intermediate layer.

15. A method as claimed in claim 14, wherein said soleplate is provided with a heating element.

16. A method as claimed in claim 14, wherein said anti-friction layer consists of a layer of predominantly aluminum oxide.

17. A method as claimed in claim 14, wherein said anti-friction layer is electrochemically formed on said soleplate by applying a voltage difference across the soleplate and an electrode in the presence of an electrically conductive material.

18. A method of manufacturing an iron which comprises a soleplate of a metal comprising aluminum, an anti-friction layer consisting of a layer of predominantly aluminum oxide, and an intermediate layer situated between the anti-friction layer and the soleplate, which method comprises the steps of injection molding said soleplate of a metal comprising aluminum, providing said intermediate layer on a surface of said injection molded soleplate, and electrochemically forming said anti-friction layer on a surface of said intermediate layer.

19. A method as claimed in claim 18, wherein the anti-friction layer consists of a layer of predominantly aluminum oxide, and said intermediate layer consists of a plate of anodizable aluminum.

20. A method as claimed in claim 18, wherein said anti-friction layer is electrochemically formed on said soleplate by applying a voltage difference across the soleplate and an electrode in the presence of an electrically conductive material.

21. A method as claimed in claim 20, wherein the thickness of the anti-friction layer ranges between 10 and 50 micrometers.

22. A method as claimed in claim 21, wherein the soleplate has an arithmetic mean roughness value ($R_a$) in the range of 0.4–0.9 micrometer, and an average asperity radius in the range of 100–250 micrometer.

23. A method as claimed in claim 22, wherein the injection molded metal surface is provided with predominantly parallel, linear structures.

24. A method as claimed in claim 23, which is provided with a heating element.

* * * * *